US007950079B2

(12) United States Patent
Ta

(10) Patent No.: US 7,950,079 B2
(45) Date of Patent: May 31, 2011

(54) METHOD AND APPARATUS FOR DISPOSABLE SPA CHAIR PEDICURE BASIN SANITATION

(75) Inventor: Lan Van Ta, Rancho Cucamonga, CA (US)

(73) Assignee: Lan Van Ta, Rancho Cucamonga, CA (US)

( * ) Notice: Subject to any disclaimer, the term of this patent is extended or adjusted under 35 U.S.C. 154(b) by 809 days.

(21) Appl. No.: 11/840,197

(22) Filed: Aug. 16, 2007

(65) Prior Publication Data

US 2009/0044330 A1 Feb. 19, 2009

(51) Int. Cl.
*A47K 3/022* (2006.01)

(52) U.S. Cl. ..... 4/622; 4/541.1

(58) Field of Classification Search ..... 4/622, 541.1, 4/541.4, 541.5

See application file for complete search history.

(56) References Cited

U.S. PATENT DOCUMENTS

| | | | | |
|---|---|---|---|---|
| 4,893,362 | A * | 1/1990 | Murphy | 4/493 |
| 5,465,436 | A | 11/1995 | Bleicher | |
| 6,772,800 | B1 | 8/2004 | Garcia | |
| 2003/0005515 | A1 * | 1/2003 | Zolotnik et al. | 4/622 |
| 2006/0242760 | A1 * | 11/2006 | Chao | 4/622 |
| 2007/0056087 | A1 * | 3/2007 | Vinokur et al. | 4/541.5 |
| 2007/0192952 | A1 * | 8/2007 | Lau | 4/541.1 |
| 2008/0276365 | A1 * | 11/2008 | Ton | 4/622 |
| 2009/0094739 | A1 * | 4/2009 | Vinokur et al. | 4/622 |

* cited by examiner

*Primary Examiner* — Khoa D Huynh

(57) ABSTRACT

A spa chair pedicure basin sanitation liner that allows a user to enjoy the water agitation benefits of a water based pedicure foot massage while preventing infection from reused basin water. The liner includes a bottom portion and a plurality of sidewalls attached to the bottom portion. The bottom portion and the plurality of sidewalls define an inner volume, which is capable of containing a liquid, such as water, filled up to a particular liquid level. Disposed within the inner volume, is gas piping that defines a gas-carrying conduit. The gas piping includes a plurality of openings through which gas can pass into the inner volume.

1 Claim, 7 Drawing Sheets

METHOD AND APPARATUS FOR DISPOSABLE SPA CHAIR PEDICURE BASIN SANITATION

BACKGROUND OF THE INVENTION

1. Field of the Invention

This invention relates generally to spa chair sanitation, and more particularly to a disposable spa chair sanitation apparatus having air massage elements.

2. Description of the Related Art

Professional salons today allow customers to receive numerous services, such as facials, manicures, and pedicures. To facilitate these services, spa chairs are often used to allow clients to sit and relax while they receive facials, manicures, and pedicures. Such spa chairs often include a pedicure basin at the foot of the chair to facilitate pedicure services and foot massages. The pedicure basin generally includes water pressure jets for inducing water agitation to massage the client's feet. To provide water pressure, conventional pedicure basins typically circulate water from the interior of the pedicure basin using external piping and a water pump, as illustrated in FIG. 1.

FIG. 1 is a schematic diagram showing a conventional pedicure massage system 100 providing water agitation using exterior piping. The conventional pedicure massage system 100 includes a pedicure basin 102, pressure jets 104, and a pump 106 connected to a basin intake 108 and water jet pipes 110. In addition, a drain 112 generally is situated on the bottom floor of the pedicure basin 102 to allow water to drain out of the pedicure massage system 100.

In operation, the drain 112 is closed and the pedicure basin 102 is filled with water. Once the pedicure basin 102 is filled, the pump 106 is turned on to begin water agitation. In the exemplary conventional pedicure massage system 100, the pump 106 draws water out of the pedicure basin 102 via the basin intake 108. The pump 106 then pumps the water through the water jet pipes 110 to the pressure jets 104, which send the water back into the pedicure basin 102. In this manner, the water flowing out of the pressure jets 104 can provide massaging action when a user places their feet into the pedicure basin 102. When the massage is complete, the water present in the pedicure basin 102 can be drained by opening the drain 112, which allows the water present in the pedicure basin 102 to drain out of the pedicure massage system 100.

However, although the water is drained out of the pedicure basin 102, water present in the basin intake 108, water jet pipes 110, and pump 106 cannot be drained out of the pedicure massage system 100. This remaining water generally contains unsanitary residue, including scale deposits, body oils, and other body fluids. As a result, when the pedicure massage system 100 is used for the next client, the water that remained in the basin intake 108, water jet pipes 110, and pump 106 after the prior use is circulated back into the pedicure basin 102. Thus, the next client to use the pedicure massage system 100 is exposed to the bacteria and other germs that may have been present in the remaining pipe water because of the prior client.

The potential for spreading germs among clients through various tools and equipment is well known within the manicuring and pedicure industries. Thus, in view of the foregoing, there is a need for sanitation systems for use with pedicure basins. The sanitation systems should not allow water to be reused from one use of the pedicure basin to the next. The sanitation systems should also allow the user to enjoy the benefits of the pedicure basin, such as bubbling water, and other water agitation on the user's feet. Moreover, the sanitation systems should allow fast and easy preparation of the pedicure basin for the next user.

SUMMARY OF THE INVENTION

Broadly speaking, the present invention addresses these needs by providing a liner having gas jets for a pedicure basin. For example, in one embodiment a liner for a pedicure basin is disclosed. The liner includes a bottom portion and a plurality of sidewalls attached to the bottom portion. The bottom portion and the plurality of sidewalls define an inner volume, which is capable of containing a liquid, such as water, filled up to a particular liquid level. Disposed within the inner volume, is gas piping that defines a gas-carrying conduit. The gas piping includes a plurality of openings through which gas can pass into the inner volume.

A liner for a pedicure basin of a spa chair is disclosed in an additional embodiment. As above, the liner includes a bottom portion and a plurality of sidewalls attached to the bottom portion. The bottom portion and sidewalls define an inner volume that is capable of containing a liquid to a particular liquid level. Disposed within the inner volume is gas piping. The gas piping defines a gas carrying conduit and includes a plurality of openings through which gas can pass into the inner volume. A portion of the gas piping extends above the liquid level during use. Also included is a drain element that is disposed over a drain of the pedicure basin during use. The drain element allows liquid to escape the inner volume when the drain is opened. In use, the portion of the gas piping extending above the liquid level forms a liner gas supply hose that is in fluid communication with a gas supply associated with the spa chair. Here, and throughout the application, fluid communication should be understood to include gas being communicated between structures. Optionally, the liner can include a top lip attached to the sidewalls. The top lip defining an open top, where the inner volume can be filled with a liquid substantially to the top lip. In one aspect, the inner volume can be substantially similar in shape to the pedicure basin. Optionally, the bottom portion, sidewalls, and gas piping can be manufactured from a flexible material capable of creating an inner volume substantially similar in shape to the pedicure basin. Yet, in one embodiment, the bottom portion, sidewalls, and gas piping can be manufactured from a semi-inflexible material having an inner volume substantially similar in shape to the pedicure basin.

In a further embodiment, a method for providing spa chair pedicure basin sanitation is disclosed. The method includes placing a liner into an inner volume of the pedicure basin. As above, the liner includes gas piping disposed within the inner volume of the liner, which defines a gas-carrying conduit and includes a plurality of openings through which gas can pass into the inner volume of the liner. The gas piping is placed in fluid communication with a gas supply, which is capable of providing a gas to the gas piping. The inner volume of the liner is filled with a liquid, and the gas supply is set such that the gas supply provides a gas to the gas piping. In this manner, the gas is supplied into the liquid via the plurality of openings in the gas piping. As mentioned above, the drain element of the liner can be placed over the drain of the pedicure basin. In this case, the drain element of the liner can be opened to allow the liquid to transfer into the drain of the pedicure basin when the user is finished using the pedicure basin.

In this manner, embodiments of the present invention advantageously leave the pedicure basin clean after use having not had any water directly in contact with it. Moreover, there is little or no clean up because the pedicure basin gas jet liner can be thrown away when constructed of disposable material. Consequently, the spa chair and pedicure basin can be reused by the next client without the risk of being exposed to the bacteria and other germs that may have been introduced into the pedicure basin gas jet liner water by the prior client. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a spa chair pedicure basin sanitation apparatus that allows a user to enjoy the water agitation benefits of a water based pedicure foot massage while preventing infection from reused basin water. Broadly speaking, embodiments of the present invention utilize waterproof material to provide a pedicure basin gas jet liner for a pedicure basin. Manufactured into the pedicure basin gas jet liner is gas jet piping that allows air to flow through the basin liner and into water disposed in the basin liner. In this manner, a user is allowed to enjoy the benefits of an air jet foot massage. In addition, the spa chair pedicure basin sanitation apparatus of the embodiments of the present invention is disposable, allowing the basin owner to remove a used basin liner and replace it with a new basin liner for use with a subsequent client.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
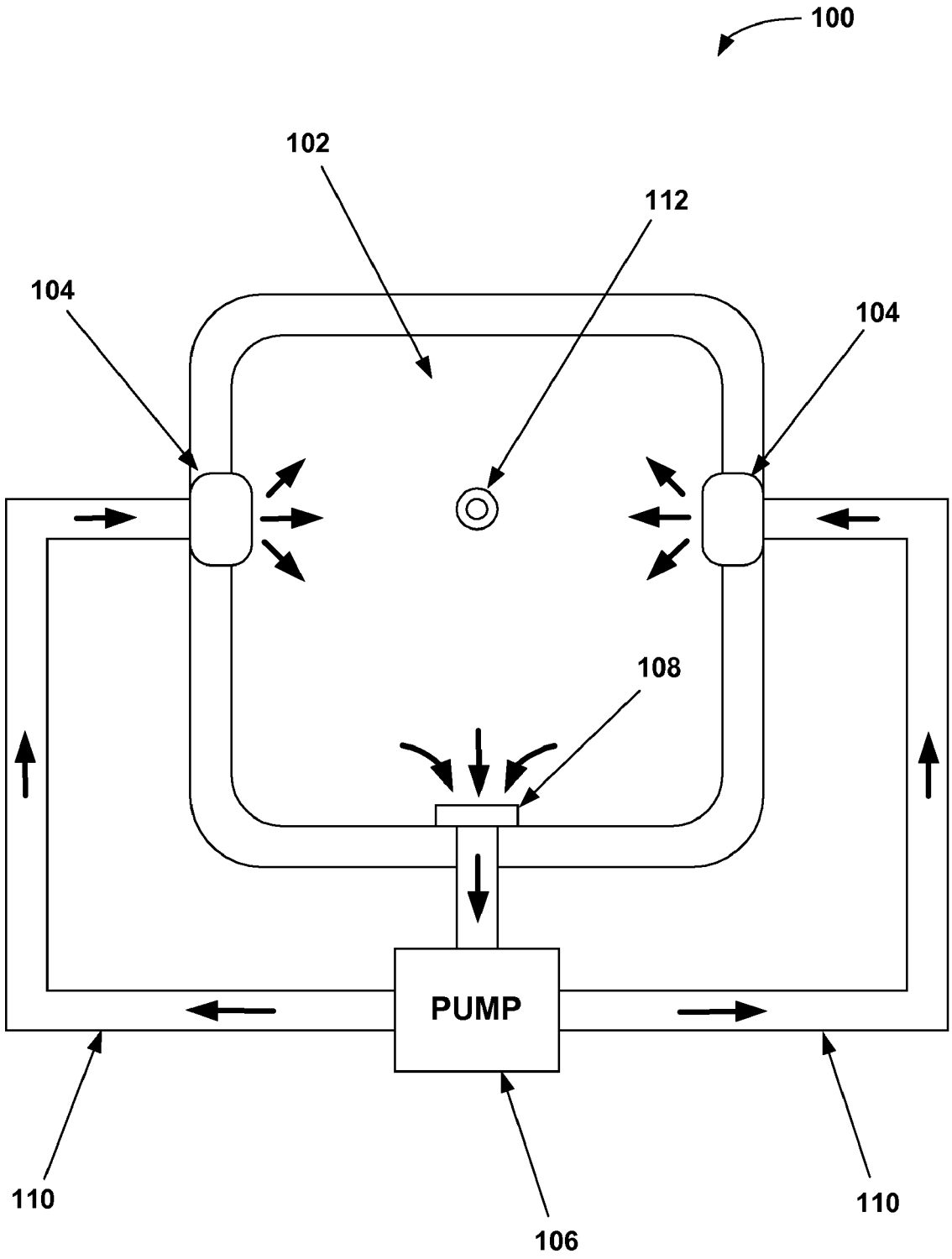
FIG. 1 (Prior Art)
FIG. 1 a schematic diagram showing a conventional pedicure massage system providing water agitation using exterior piping.
Figure 2:
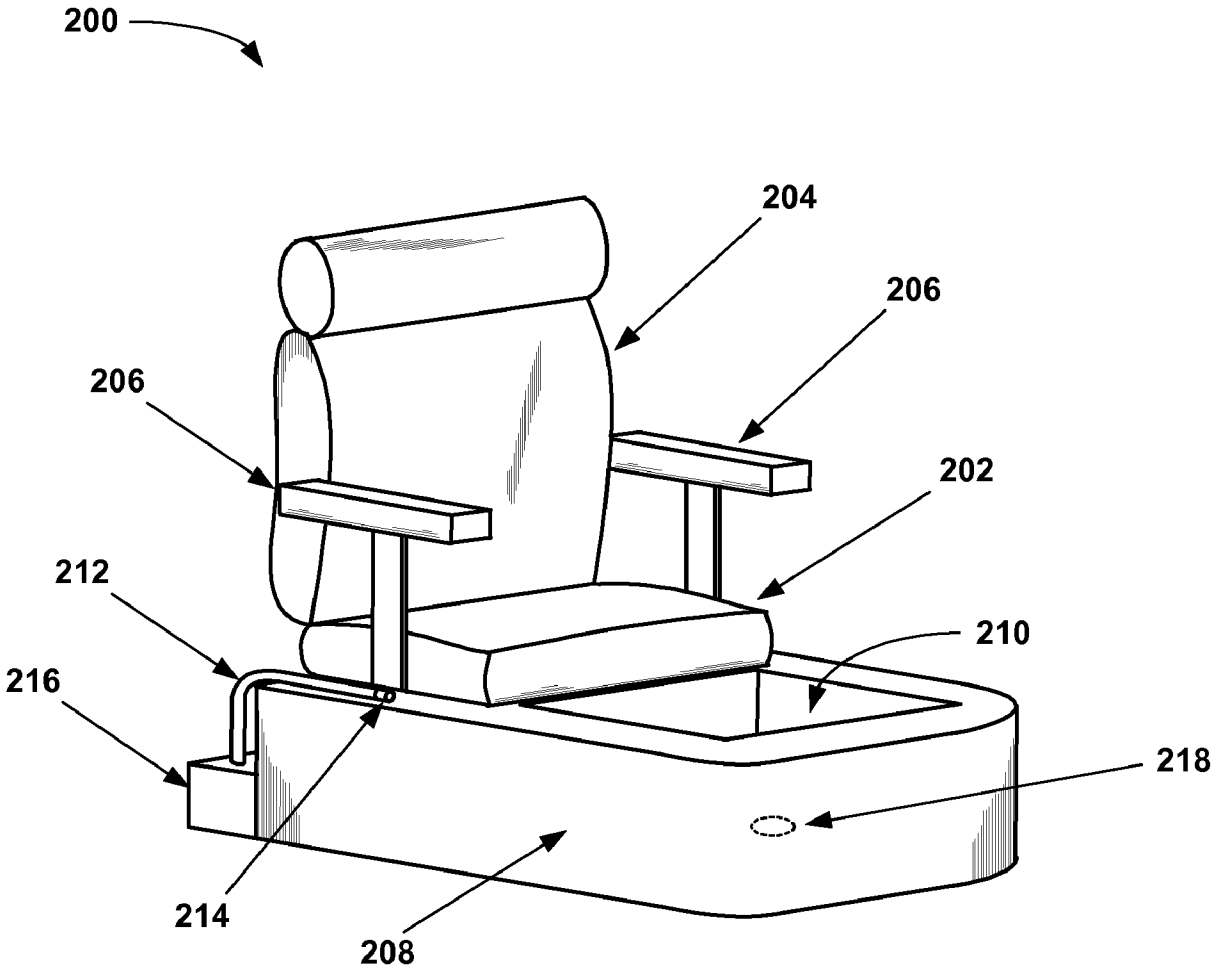
FIG. 2 is a diagram showing a spa chair constructed in accordance with an embodiment of the present invention.

FIG. 1 was described in terms of the prior art. FIG. 2 is a diagram showing a spa chair 200 constructed in accordance with an embodiment of the present invention. The spa chair 200 includes a seat 202 connected to a backrest 204 and a pair of arm rests 206. The seat 202 of the spa chair 200 is further connected to a spa chair base 208, which also houses a pedicure basin 210. In proximity to, or attached to, the spa chair base 208 is a spa chair gas supply hose 212. Although generally constructed to supply air, it should be noted that the spa chair gas supply hose 212 can be constructed to provide any type of gas as will be apparent to those skilled in the art after a careful reading of the present disclosure. The spa chair gas supply hose 212 generally is connected to a gas supply 216 to allow gas to be supplied via the gas hose nozzle 214. For example, in one embodiment of the present invention, the gas supply 216 is an air pump, located below the seat 202 and behind the chair base 208, that forces air through the spa chair gas supply hose 212 to the gas hose nozzle 214.

As shown in FIG. 2, the pedicure basin 210 is located within the spa chair base 208, below and forward of the seat 202. The pedicure basin 210 is designed to hold a liquid, such as water, and generally includes a drain 218 in the bottom panel of the pedicure basin 210. A faucet (not shown) can optionally be attached to the pedicure basin 210 to allow liquid to be easily flowed into the pedicure basin 21 0.

As mentioned previously, although prior art pedicure basins allowed water to be drained out of the pedicure drain after use, water present in the basin intake, water jet pipes, and water pump could not be drained out of the system. As a result, when the pedicure basin was used for the next client, the water that remained in the basin intake, water jet pipes, and water pump was circulated back into the pedicure basin. Thus, the next client to use the pedicure basin was exposed to the bacteria and other germs that may have been present in the remaining pipe water because of the prior client. Embodiments of the present invention address this issue by providing pedicure basin sanitation apparatus that allows a user to enjoy the water agitation benefits of a water based pedicure foot massage while preventing infection from reused basin water, as illustrated next, with reference to FIG. 3.

Figure 3:
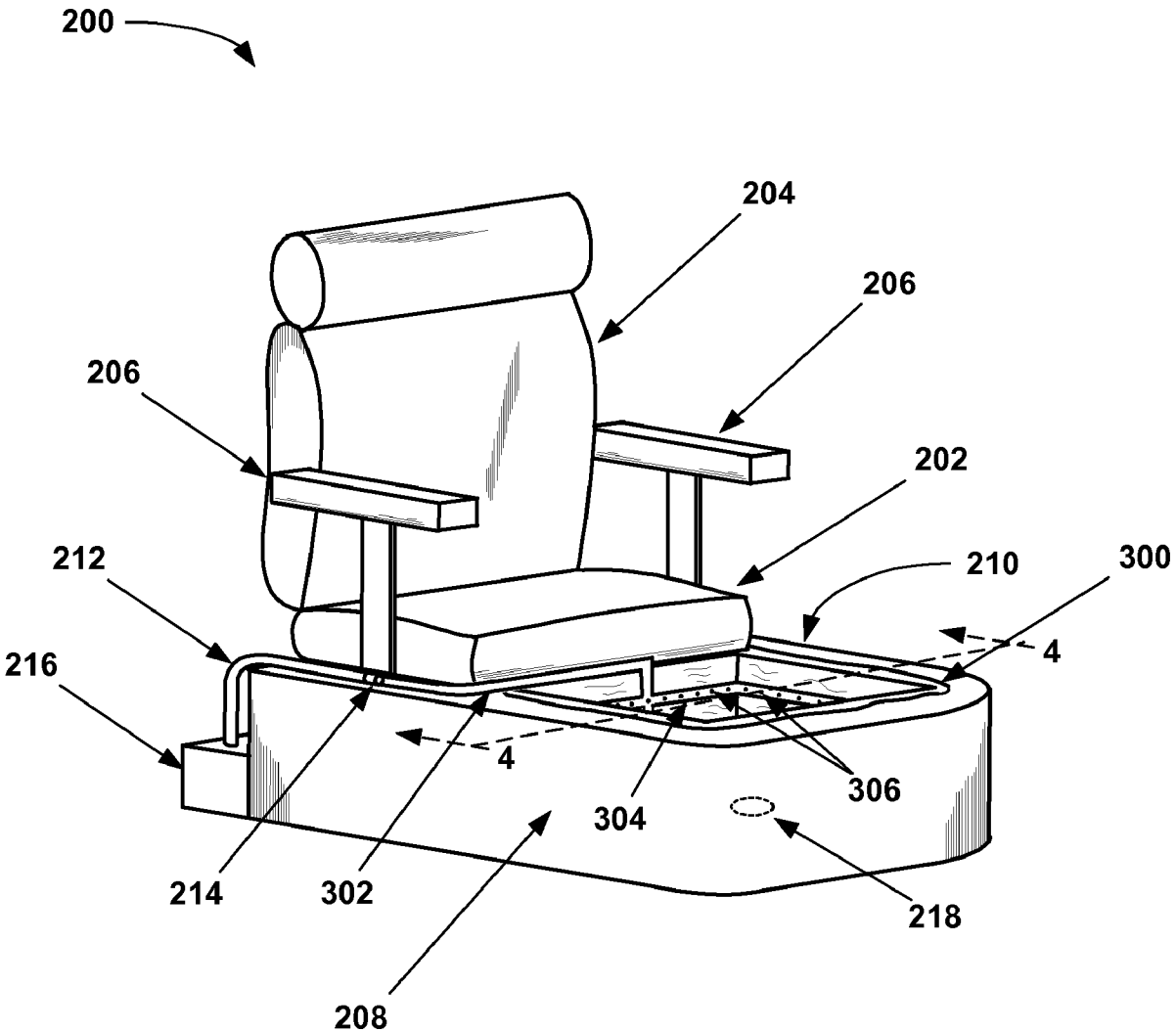
FIG. 3 is a diagram showing the spa chair including a pedicure basin gas jet liner 300 extending within the interior volume of the pedicure basin and extending over a top lip thereof, in accordance with an embodiment of the present invention.

FIG. 3 is a diagram showing the spa chair 200 including a pedicure basin gas jet liner 300 extending within the interior volume of the pedicure basin 210 and extending over a top lip thereof, in accordance with an embodiment of the present invention. As mentioned above, the spa chair 200 includes a seat 202 connected to a backrest 204 and a pair of arm rests 206. The seat 202 of the spa chair 200 is further connected to a spa chair base 208, which also houses a pedicure basin 21 0. In proximity to, or attached to, the spa chair base 208 is a spa chair gas supply hose 212. The spa chair gas supply hose 212 generally is connected to a gas supply 216, such as an air pump, to allow gas to be supplied via the gas hose nozzle 214.

In addition, a pedicure basin gas jet liner 300 is disposed within the pedicure basin 200. The pedicure basin gas jetliner 300 is constructed from a waterproof material to contain water introduced into the pedicure basin gas jet liner 300. As illustrated in FIG. 3, the pedicure basin gas jet liner 300 provides a liner for the pedicure basin 200. Manufactured into the pedicure basin gas jet liner 300 is gas jet piping/tubes 304 that includes a plurality of gas jet holes 306 that allow a gas, such as air to flow into water disposed in the pedicure basin gas jet liner 300 through a liner gas supply hose 302. The liner gas supply hose 302 is connected to the gas hose nozzle 214. As a result, gas provided from the gas supply 216 is allowed to flow through the spa chair gas supply hose 212, gas hose nozzle 214, liner gas supply hose 302, and gas jet piping 304 into water located within the pedicure basin gas jet liner 300 and pedicure basin 210.

In operation, the user places the pedicure basin gas jet liner 300 into the pedicure basin 210 of the spa chair 200, as illustrated in FIG. 3. In addition, the liner gas supply hose 302 is attached to the gas hose nozzle 214. Once the pedicure basin gas jet liner 300 is in place, water can be introduced into the pedicure basin gas jet liner 300, which lines the pedicure basin 210. The gas supply 216 can then be powered on to provide gas to the liner gas supply hose 302 via the spa chair gas supply hose 212 and gas hose nozzle 214. The gas, for example air, is introduced into the gas jet piping 304 via the liner gas supply hose 302, and allowed to escape into the water present in the pedicure basin gas jet liner 300 via the gas jet holes 306 located in the gas jet piping/tubes 304. In this manner, a user is allowed to enjoy the benefits of an airjet foot massage.

Once the user is finished using the spa chair 200. A drain located in the pedicure basin gas jet liner 300 can be opened to allow the water to escape into the drain 218 of the pedicure basin 210. Thereafter, the liner gas supply hose 302 is detached from the gas hose nozzle 214 and the pedicure basin gas jet liner 300 can be removed from the pedicure basin 210. In one embodiment, the pedicure basin gas jet liner 300 is constructed of a low cost disposable material, thus allowing the user to dispose of the pedicure basin gas jet liner 300 after use.

When the pedicure basin gas jet liner 300 is removed from the pedicure basin 210, the pedicure basin 210 is clean having not had any water directly in contact with it. Moreover, there is little or no clean up because the pedicure basin gas jet liner 300 can be thrown away when constructed of disposable material. Consequently, the spa chair 200 and pedicure basin 210 can be reused by the next client without the risk of being exposed to the bacteria and other germs that may have been introduced into the pedicure basin gas jet liner 300 water by the prior client.

Figure 4A:
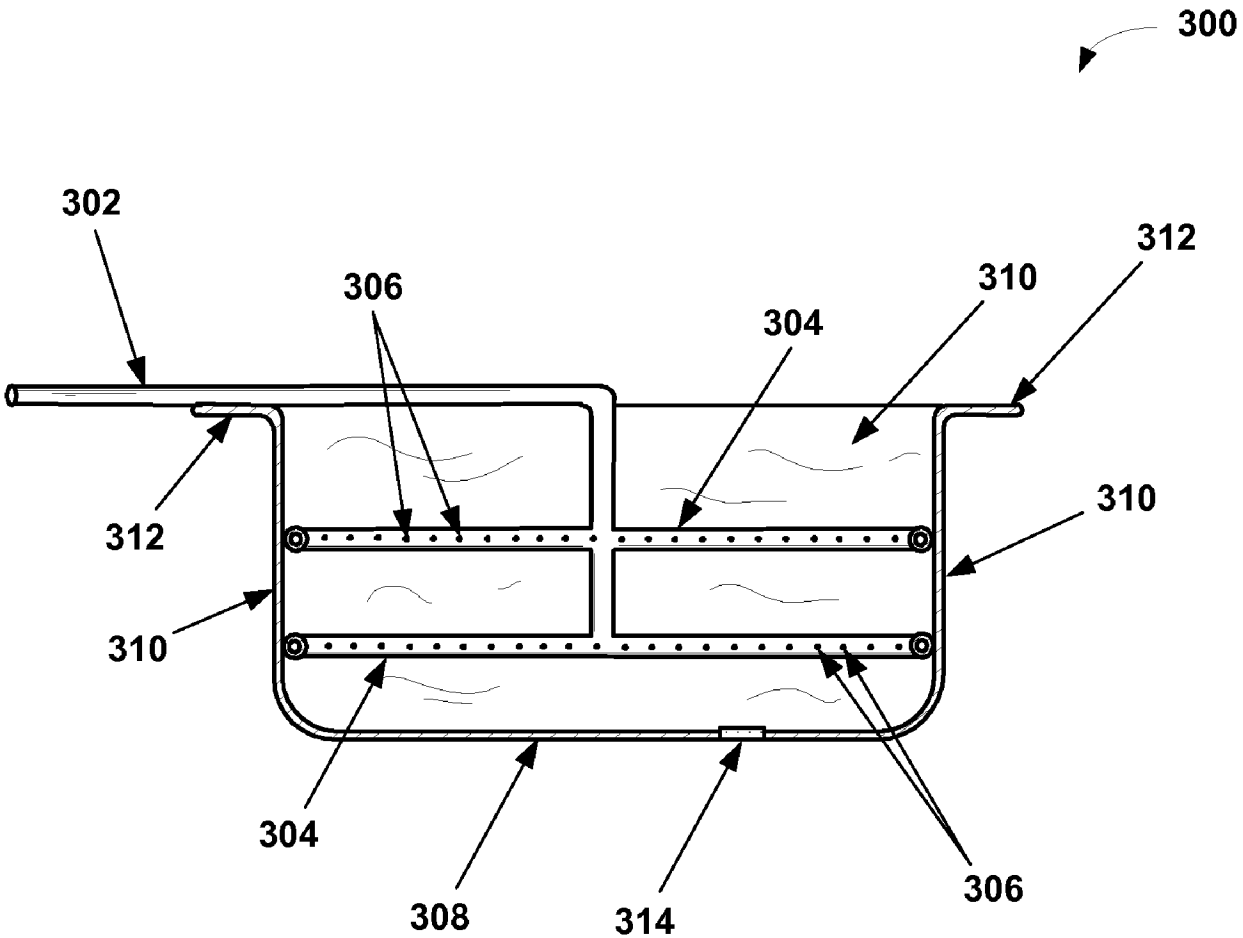
FIG. 4A is a cross sectional view, generally along line 4-4 of FIG. 3, showing the pedicure basin gas jet liner, in accordance with an embodiment of the present invention.

FIG. 4A is a cross sectional view, generally along line 4-4 of FIG. 3, showing the pedicure basin gas jet liner 300, in accordance with an embodiment of the present invention. The pedicure basin gas jet liner 300 includes a bottom portion 308, a plurality of sidewalls 310 and a top lip 312, which defines an open top. An inner volume is defined by the bottom portion 308 and sidewalls 310, which is capable of containing a liquid substantially to the top lip 312. Typically, the pedicure basin gas jet liner 300 is shaped similar to the pedicure basin 210 of the spa chair 200. In this manner, the pedicure basin gas jet liner 300 can be easily placed within and upon the pedicure basin 210 of the spa chair 200.

Manufactured into the pedicure basin gas jet liner 300 is a liner gas supply hose 302 having gas jet piping/tubes 304, which includes a plurality of gas jet holes 306. The gas jet piping 304 and liner gas supply hose 302 define a gas-carrying conduit capable of supplying gas to the liner. In one embodiment, the gas jet piping 304 extends around the inner circumference of the pedicure basin gas jet liner 300. For example, as illustrated in FIG. 4A, one embodiment includes gas jet piping 304 extending in two circular patterns around the inner circumference of the pedicure basin gas jet liner 300. In the example of FIG. 4A, the gas jet piping 304 extends in an upper circular pattern and a lower circular pattern disposed below the upper circular pattern and connected via a portion of the liner gas supply hose. However, it should be noted that gas jet piping 304 of the embodiments of the present invention can be patterned in any manner capable providing gas to the interior of the pedicure basin gas jet liner 300, as will be apparent to those skilled in the art after a careful reading of the present disclosure.

In one embodiment, the gas jet piping 304 can be manufactured from the same material used in the manufacture of the bottom portion 308 and sidewalls 310 of the pedicure basin gas jet liner 300. In a further embodiment, the gas jet piping 304 can be manufactured from thicker material than used in the manufacture of the bottom portion 308 and sidewalls 310 of the pedicure basin gas jet liner 300. In this manner, the gas jet piping can be strengthened to endure the increased pressure from high pressure gas supplies.

As mentioned above, a plurality of gas jet holes 306 are manufactured into the gas jet piping 304. The gas jet holes 306 are openings in the gas jet piping 304 that allow gas present in the gas jet piping 304 to pass into the inner volume of the pedicure basin gas jet liner 300. In one embodiment, the gas jet holes 306 are circular in shape, each disposed approximately 0.25 inches apart. However, it should be noted that the gas jet holes 306 can be manufactured in any shape and disposed in any pattern as needed for a particular use or pedicure basin shape, as will be apparent to those skilled in the art after a careful reading of the present disclosure. In this manner, when water is present in the inner volume of the pedicure basin gas jet liner 300 and a gas, such as air, is present in the gas jet piping 304, the gas is released through the gas jet holes 306 and creates a bubbling agitation within the water that creates a bubbling and massaging sensation on a user's feet when positioned in the pedicure basin.

Disposed in the bottom portion 308 of the pedicure basin gas jet liner 300 is a liner drain 314. In one embodiment, the liner drain 314 can be a removable drain element removably affixed to the bottom portion 308 of the pedicure basin gas jet liner 300. In this embodiment, the user can remove the drain element 314 to allow liquid to escape the pedicure basin gas jet liner 300 through bottom portion 308 via the liner drain 314. In an additional embodiment, the liner drain 314 is a perforated section in the bottom portion 308 of the pedicure basin gas jet liner 300. In this embodiment, the user can puncture the drain element 314 to allow liquid to escape the pedicure basin gas jet liner 300 through bottom portion 308 via the liner drain 314. However, it should be noted that any kind of drainage element capable of allowing liquid to escape the pedicure basin gas jet liner 300 can be utilized with the embodiments of the present invention, as will be apparent to those skilled in the art after a careful reading of the present disclosure.

The pedicure basin gas jet liner 300 generally is made of a thin material, such as plastic, which is at least water impervious, such that it can contain a quantity of water and prevent infiltration of the water therethrough during use. For example, in one embodiment, the pedicure basin gas jet liner 300 is made of a soft plastic, having a thickness of substantially 0.5 to 1.0 millimeters. However, in some embodiments, the pedicure basin gas jet liner 300 can be constructed from a ridged material also, if shaped similar to the pedicure basin 210 of the spa chair 200.

Figure 4B:
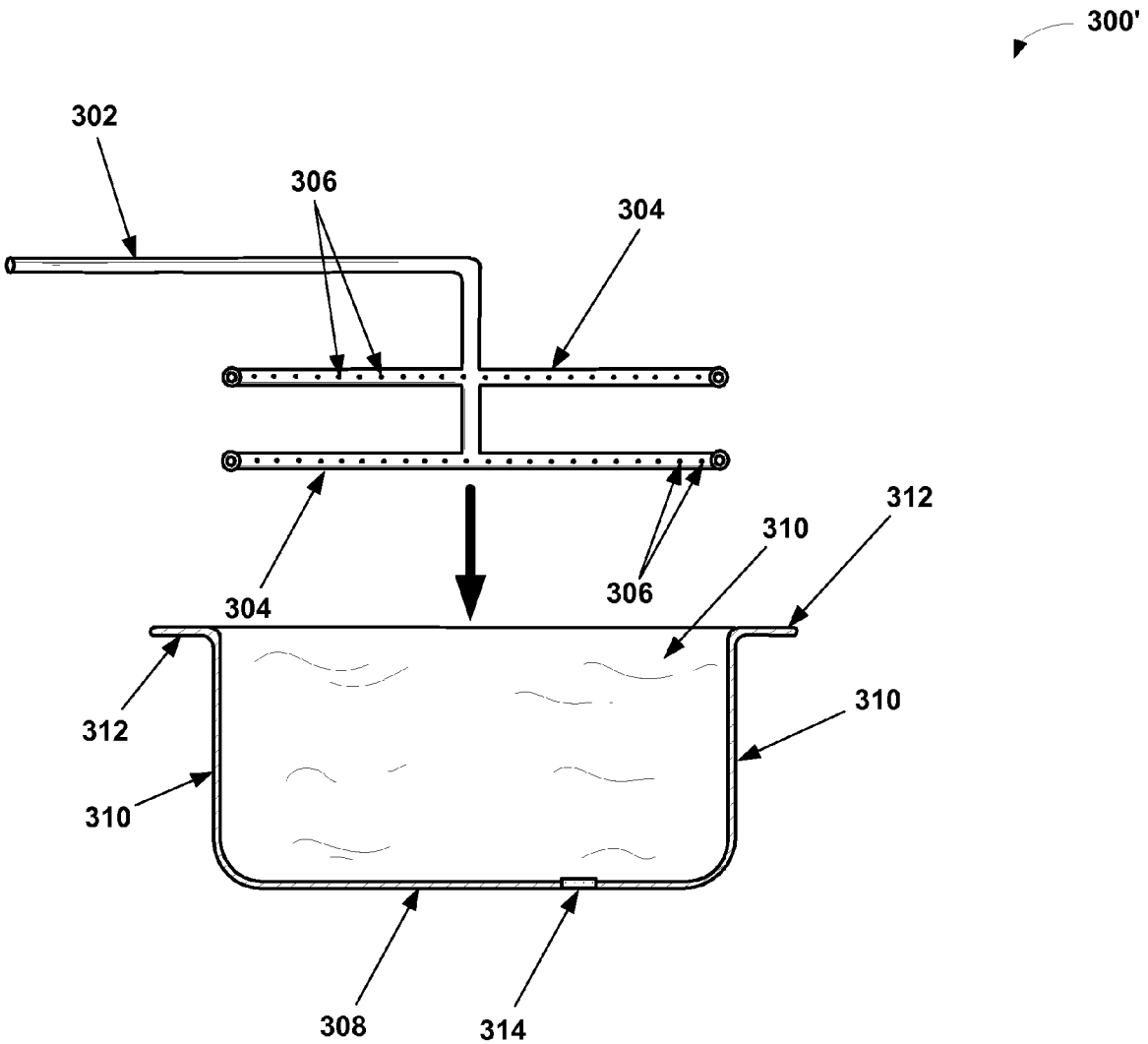
FIG. 4B is a cross sectional view, generally along line 4-4 of FIG. 3, showing the pedicure basin gas jet liner embodied in two separate elements, in accordance with an embodiment of the present invention.

FIG. 4B is a cross sectional view, generally along line 4-4 of FIG. 3, showing the pedicure basin gas jet liner 300' embodied in two separate elements, in accordance with an embodiment of the present invention. In the embodiment of FIG. 4B, the pedicure basin gas jet liner 300' is separated into two portions. A first portion includes a bottom portion 308, a plurality of sidewalls 310 and a top lip 312, which defines an open top. An interior volume is defined by the bottom portion 308 and sidewalls 310, which is capable of containing a liquid substantially to the top lip 312. Typically, the pedicure basin gas jet liner 300' is shaped similar to the pedicure basin 210 of the spa chair 200. In this manner, the pedicure basin gas jet liner 300' can be easily placed within and upon the pedicure basin 210 of the spa chair 200.

However, in the embodiment of FIG. 4B, the gas supply hose 302 and gas jet piping 304 are separate from the sidewalls 310. As above, the liner gas supply hose 302 is connected to the gas jet piping 304, which includes a plurality of gas jet holes 306. The gas jet piping 304 and liner gas supply hose 302 define a gas-carrying conduit capable of supplying gas to the liner. In one embodiment, the gas jet piping 304 extends around the inner circumference of the pedicure basin gas jet liner 300' when the gas jet piping 304 is inserted into the interior volume defined by the bottom portion 308 and sidewalls 3 10. As can be appreciated, when the gas jet piping 304 is inserted into the interior volume defined by the bottom portion 308 and sidewalls 310, the pedicure basin gas jetliner 300' closely resembles the pedicure basin gas jet liner 300 of FIG. 4A.

As illustrated in FIG. 4B, one embodiment includes gas jet piping 304 extending in two circular patterns around the inner circumference of the pedicure basin gas jet liner 300'. In the example of FIG. 4B, the gas jet piping 304 extends in an upper circular pattern and a lower circular pattern disposed below the upper circular pattern and connected via a portion of the liner gas supply hose. However, it should be noted that gas jet piping 304 of the embodiments of the present invention can be patterned in any manner capable providing gas to the interior of the pedicure basin gas jet liner 300', as will be apparent to those skilled in the art after a careful reading of the present disclosure. In operation, as mentioned above, the pedicure basin gas jet liner 300/300' is placed over the pedicure basin 210 of the spa chair 200, as illustrated next with reference to FIG. 5.

Figure 5:
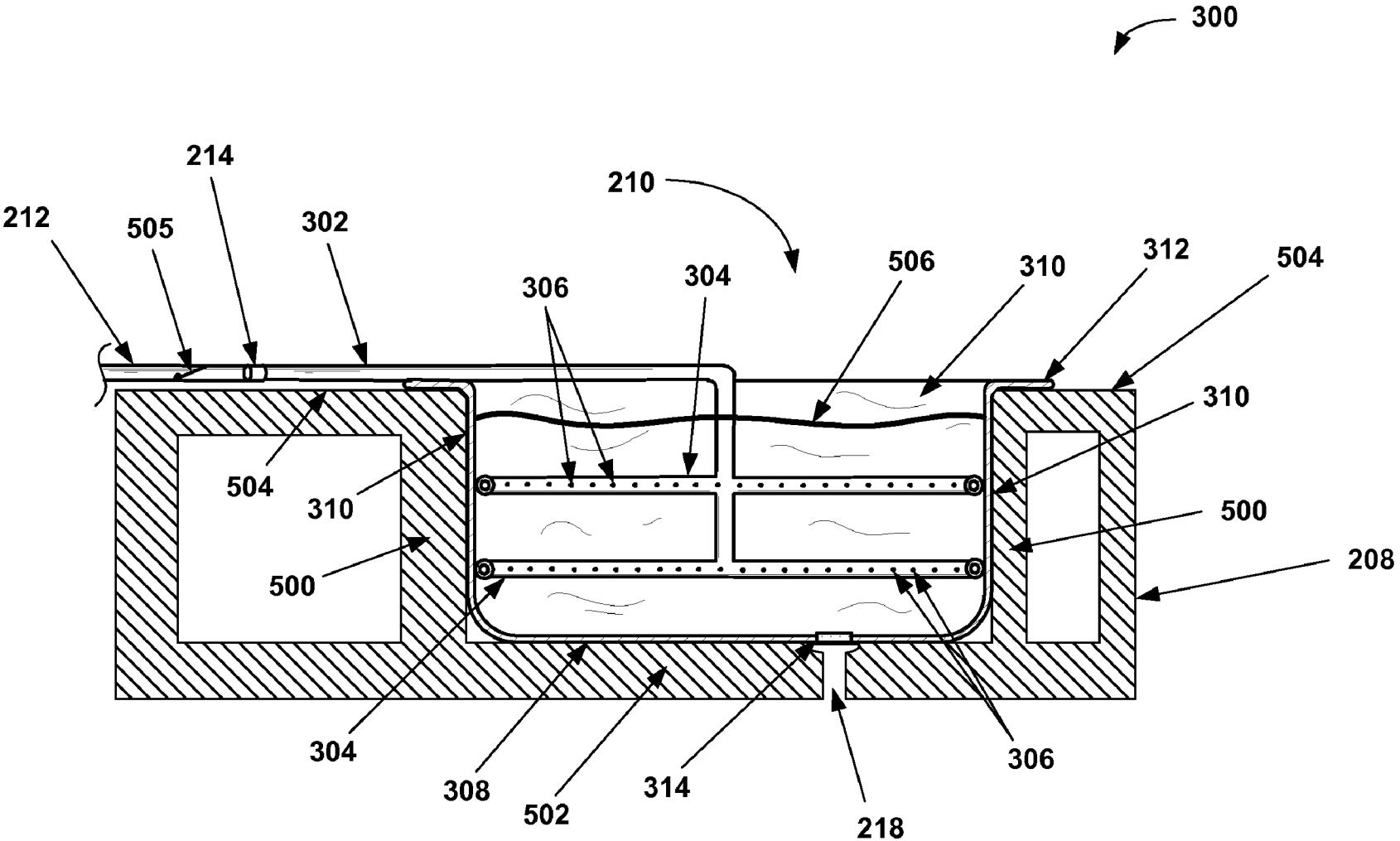
FIG. 5 is a cross sectional view showing the pedicure basin gas jet liner situated within the pedicure basin of a spa chair, in accordance with an embodiment of the present invention.

FIG. 5 is a cross sectional view showing the pedicure basin gas jet liner 300 situated within the pedicure basin 210 of a spa chair, in accordance with an embodiment of the present invention. The pedicure basin 210 of the spa chair is generally formed in the spa chair base 208 and includes a bottom portion 502 and a plurality of sidewalls 500. The sidewalls 500 of the pedicure basin 210 end generally at the top section 504 of the spa chair base 208. An interior volume of the pedicure basin 210 is defined by the bottom portion 502 and sidewalls 500. At the bottom of the interior volume, and situated in the bottom portion 502 of the pedicure basin 210 is a basin drain 218, which allows liquid to escape the pedicure basin 210.

Within the interior volume of the pedicure basin 210 is situated a pedicure basin gas jet liner 300. The pedicure basin gas jet liner 300 includes a bottom portion 308, a plurality of sidewalls 310 and a top lip 312, which defines an open top. An interior volume is defined by the bottom portion 308 and sidewalls 310, which is capable of containing a liquid substantially to the top lip 312. Manufactured into the pedicure basin gas jet liner 300 is a liner gas supply hose 302 connected to gas jet piping 304, which includes a plurality of gas jet holes 306. Disposed in the bottom portion 308 of the pedicure basin gas jet liner 300, and positioned substantially over the basin drain 218 is a liner drain 314.

As illustrated in FIG. 5, the pedicure basin gas jet liner 300 conforms to the interior volume of the pedicure basin 210, with the bottom portion 308 of the pedicure basin gas jet liner 300 closely accommodating the bottom portion 502 of the pedicure basin 210, and the sidewalls 310 of the pedicure basin gas jet liner 300 closely accommodating the sidewalls 500 of the pedicure basin 210. Further, the top lip 312 of the pedicure basin gas jet liner 300 extends over the top section 504 of the spa chair base 208, which also defines an open top of the pedicure basin 210.

In operation, the pedicure basin gas jet liner 300 is placed into the pedicure basin 210. In addition, the liner gas supply hose 302 is attached to the gas hose nozzle 214. Once the pedicure basin gas jet liner 300 is in place, water can be introduced into the pedicure basin gas jet liner 300, which lines the pedicure basin 210. As mentioned above, the water is introduced into the pedicure basin gas jet liner 300 to a particular liquid level, as indicated by the liquid level 506.

The gas supply can then be powered on to provide gas to the liner gas supply hose 302 via the spa chair gas supply hose 212 and gas hose nozzle 214. Optionally, a check valve 505 can be included as extra protection against liquid contaminating the gas system. The gas, for example air, is introduced into the gas jet piping 304 via the liner gas supply hose 302, and allowed to escape into the water present in the pedicure basin gas jet liner 300 via the gas jet holes 306 located in the gas jet piping 304. In this manner, a user is allowed to enjoy the benefits of an air jet foot massage.

Once the user is finished using the spa chair 200, the liner drain 314 located in the pedicure basin gas jet liner 300 can be opened to allow the water to escape into the basin drain 218 of the pedicure basin 210. Thereafter, the liner gas supply hose 302 is detached from the gas hose nozzle 214 and the pedicure basin gas jet liner 300 can be removed from the pedicure basin 210. In one embodiment, the pedicure basin gas jetliner 300 is constructed of a low cost disposable material, thus allowing the user to dispose of the pedicure basin gas jet liner 300 after use.

When the pedicure basin gas jet liner 300 is removed from the pedicure basin 210, the pedicure basin 210 is clean having not had any water directly in contact with it. Moreover, there is little or no clean up because the pedicure basin gas jet liner 300 can be thrown away when constructed of disposable material. Consequently, the spa chair 200 and pedicure basin 210 can be reused by the next client without the risk of being exposed to the bacteria and other germs that may have been introduced into the pedicure basin gas jet liner 300 water by the prior client.

Figure 6:
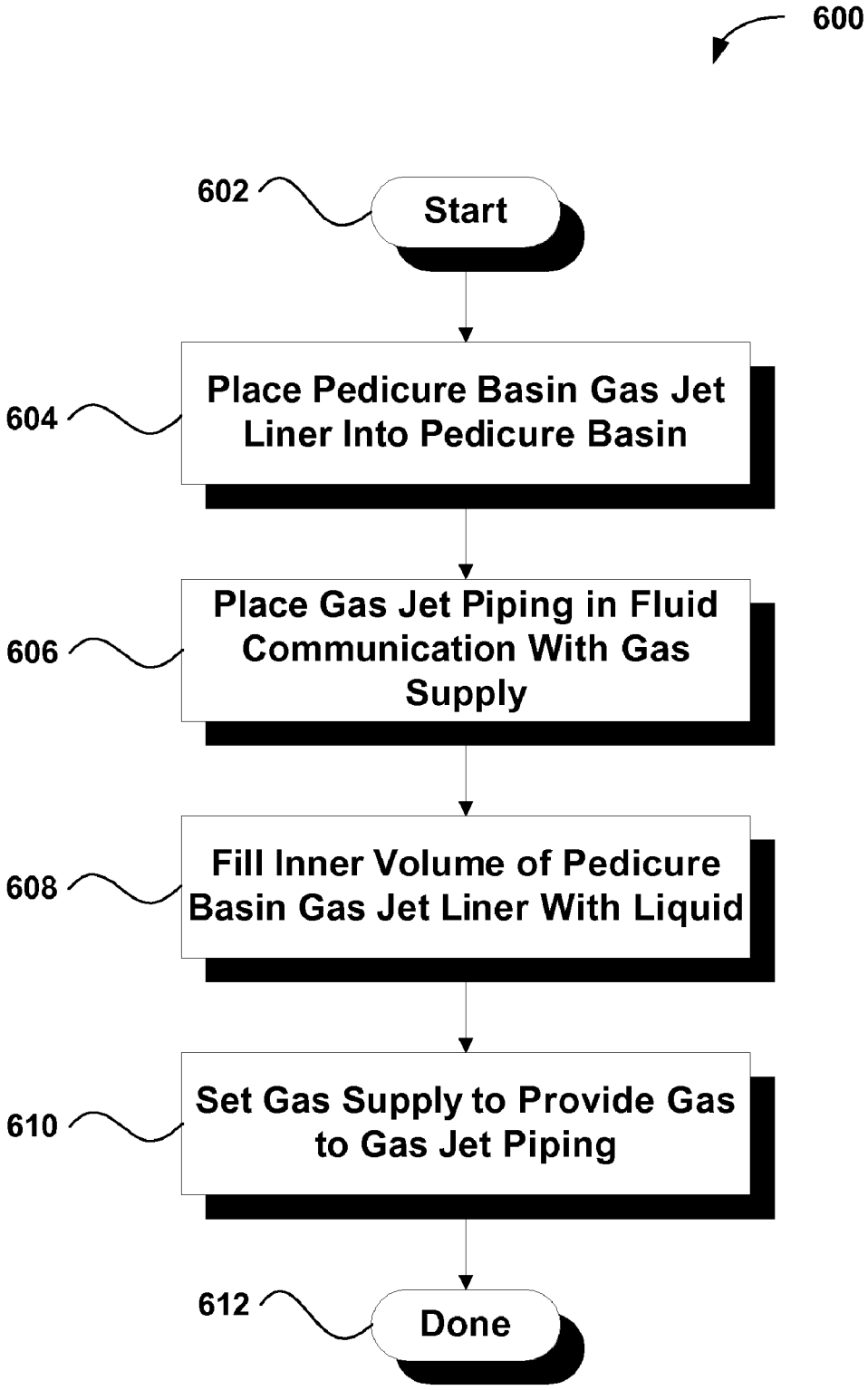
FIG. 6 is a flowchart showing a method for providing spa chair pedicure basin sanitation, in accordance with an embodiment of the present invention.

FIG. 6 is a flowchart showing a method 600 for providing spa chair pedicure basin sanitation, in accordance with an embodiment of the present invention. In an initial operation 602, preprocess operations are performed. Preprocess operations can include, for example, determining a gas pressure for the gas supply, setting a proper spa chair seat height for a client, and other preprocess operations that will be apparent to those skilled in the art after a careful reading of the present disclosure.

In operation 604, a pedicure basin gas jet liner is placed into the pedicure basin of a spa chair. As mentioned above, the pedicure basin of the spa chair is generally located at the base of the spa chair and includes an interior volume defined by the bottom portion and sidewalls of the pedicure basin. At the bottom of the pedicure basin interior volume is a basin drain that allows liquid to escape the pedicure basin. In operation 604, the pedicure basin gas jet liner typically is placed into the pedicure basin such that the drain element of the pedicure basin gas jet liner is placed over the basin drain of the pedicure basin.

When placed into the pedicure basin, the pedicure basin gas jet liner conforms to the interior volume of the pedicure basin, with the bottom portion of the pedicure basin gas jet liner closely accommodating the bottom portion of the pedicure basin, and the sidewalls of the pedicure basin gas jet liner closely accommodating the sidewalls of the pedicure basin.

Optionally, a top lip of the pedicure basin gas jet liner can extend over the top section of the pedicure basin.

In operation 606, the gas jet piping of the pedicure basin gas jet liner is paced in fluid communication with the gas supply. As described above, a spa chair gas supply, such as an air pump, is located in proximity to, or attached to, the base of the spa chair. In addition, a spa chair gas supply hose generally is connected to a gas supply to allow gas to be supplied via a gas hose nozzle situated at the end of the spa chair gas supply hose. In operation 606, the gas jet piping, which is connected to a liner gas supply hose, is paced in fluid communication with the gas supply by connecting the liner gas supply hose to the gas hose nozzle of the spa chair gas supply hose.

Once the pedicure basin gas jet liner is in place and the gas jet piping is in fluid communication with a gas supply, the inner volume of the pedicure basin gas jet liner is filled with liquid in operation 608. The liquid, for example water, is introduced into the pedicure basin gas jet liner, which lines the pedicure basin, up to a particular liquid level. For example, the liquid can be introduced into the pedicure basin gas jet liner substantially to the top lip of the liner. However, it should be noted that the pedicure basin gas jet liner can be filled with liquid up to any level. In one embodiment, the liquid level is at a level above the gas jet piping to allow gas to be introduced into the liquid during use.

In operation 610, the gas supply is set to provide gas to the gas jet piping. For example, the gas supply can be powered on to provide gas to the liner gas supply hose via the spa chair gas supply hose and gas hose nozzle. The gas, such as air, is introduced into the gas jet piping via the liner gas supply hose, and allowed to escape into the water present in the pedicure basin gas jet liner via the gas jet holes located in the gas jet piping. In this manner, when liquid is present in the inner volume of the pedicure basin gas jet liner and a gas, such as air, is present in the gas jet piping, the gas is released through the gas jet holes and creates a bubbling agitation within the water that creates a bubbling and massaging sensation on a user's feet when positioned in the pedicure basin. Thus, the user is allowed to enjoy the benefits of an airjet foot massage.

Post process operations are performed in operation 612. Post process operations can include, for example, opening the drain element of the pedicure basin gas jet liner, draining the liquid from the liner, removing the liner gas supply hose from the nozzle of the spa chair gas supply hose, and disposing of the liner. For example, when done using the pedicure basin, the drain element located in the pedicure basin gas jet liner can be opened to allow the water to escape into the drain of the pedicure basin. Thereafter, the liner gas supply hose is detached from the gas hose nozzle and the pedicure basin gas jet liner can be removed from the pedicure basin. In one embodiment, the pedicure basin gas jet liner is constructed of a low cost disposable material, thus allowing the user to dispose of the pedicure basin gas jet liner after use.

Thus, embodiments of the present invention advantageously leave the pedicure basin clean after use having not had any water directly in contact with it. Moreover, there is little or no clean up because the pedicure basin gas jet liner can be thrown away when constructed of disposable material. Consequently, the spa chair and pedicure basin can be reused by the next client without the risk of being exposed to the bacteria and other germs that may have been introduced into the pedicure basin gas jet liner water by the prior client.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for providing a disposable, one-time use sanitation system for use with spa chair pedicure apparatus, wherein the spa chair pedicure apparatus comprises a spa chair (200) including a seat (202) connected to a backrest (204) and a pair of arm rest (206), the seat further connected to a spa chair base (208) which houses a pedicure basin (210), the pedicure basin (210) is formed within the spa chair base (208) below and forward of the seat (202) and includes a bottom portion (502) and a plurality of sidewalls (500), the pedicure basin is design to hold water and includes a drain (218) in the bottom portion of the pedicure basin (210) for allowing water to escape the pedicure basin, the sidewalls of the pedicure basin end at the top section (504) of the spa chair base (208), the pedicure basin (210) having an interior volume defined by the bottom portion (502) and sidewalls (500), a spa chair gas supply hose (212) is attached to the upper surface of the spa chair base (208), the spa chair gas supply hose (212) having a first end equipped with a gas hose nozzle (214) and a second end connected to an air pump (216) located below the seat (202) and behind the spa chair base (208), the gas hose nozzle (214) further includes a check valve (505); wherein the disposal, one-time use sanitation system comprises a pedicure basin gas jet liner (300) extending within the entire interior volume of the pedicure basin (210) and having a shape similar to the pedicure basin (210) of the spa chair (200), the pedicure basin gas jet liner (300) includes a bottom portion (308), a plurality of sidewalls (310) and a top lid (312) which defines an open top, an inner volume is defined by the bottom portion (308) and sidewalls (310), the interior volume is designed to hold water substantially to the top lip (312), a gas-carrying conduit comprising a liner gas supply hose (302) having a plurality of jet tubes (304) at one end and an opposed end for connecting to the gas hose nozzle (214) of the spa chair gas supply hose (212), the jet tubes (304) having a plurality of jet holes (306) for allowing air from the air pump (216) to pass into the inner volume of the pedicure basin gas jet liner (300), the pedicure basin gas jet liner (300) also includes a removable liner drain (314) formed on the bottom portion (308) thereof, the liner drain (314) is substantially positioned over and aligned with the basin drain (218) when pedicure basin gas jet liner (300) is placed inside the interior volume of the pedicure basin (210), the method comprises the steps of:

first, placing the pedicure basin gas jet liner (300) into the interior volume of the pedicure basin (210) with the top lid (312) extending over the top section (504), second, adjusting the removable liner drain (314) so that the removable liner drain (314) is substantially positioned over and aligned with the basin drain (218), third, lowering the liner gas supply hose (302) with a plurality of jet tubes (304) into the bottom portion of the pedicure basin (210) such that the plurality of jet tubes (304) are being disposed inside the inner volume and placed on top of the pedicure basin gas jet liner (300), the plurality of jet tubes (304) is designed to conform with the contour of the pedicure basin, fourth, connecting the opposed end of the liner gas supply hose (302) to the gas hose nozzle (214) of the spa chair gas supply hose (212), fifth, filling the inner volume of the pedicure basin gas jet liner (300) with water, sixth, activating the air pump (216) such air is supply into the water via the plurality of jet holes (306) of the plurality of jet tubes (304), wherein the air released from the jet holes (306) creates a bubbling agitation within the water that creates a bubbling and massaging sensation on a user's feet when positioned in the pedicure basin, seventh, when service is completed, opening the removable liner drain (314) of the pedicure basin gas jet liner (300) to allow used water to escape into the basin drain (218) of the pedicure basin (210), eighth, disconnecting the liner gas supply hose (302) from the gas hose nozzle (214), ninth, removing the pedicure basin gas jet liner (300) from the pedicure basin (210), and tenth, discarding the pedicure basin gas jet liner (300) and the liner gas supply hose (302) with the plurality of jet tubes (304).

* * * * *